United States Patent [19]

Smith et al.

[11] Patent Number: 4,499,156

[45] Date of Patent: Feb. 12, 1985

[54] TITANIUM METAL-MATRIX COMPOSITES

[75] Inventors: Paul R. Smith, Englewood; Francis H. Froes, Beavercreek, both of Ohio

[73] Assignee: The United States of America as represented by the Secretary of the Air Force, Washington, D.C.

[21] Appl. No.: 477,793

[22] Filed: Mar. 22, 1983

[51] Int. Cl.[3] ..... C22C 32/00; C22F 1/18

[52] U.S. Cl. ..... 428/614; 148/11.5 F; 148/11.5 Q

[58] Field of Search ..... 148/11.5 Q, 11.5 R, 148/11.5 F; 420/418, 421; 428/608, 614

[56] References Cited

PUBLICATIONS

V. C. Peterson, F. H. Froes and R. F. Malone, "Metallurgical Characteristics and Mechanical Properties of Beta III, A Heat-Treatable Beta Titanium Alloy", Proceedings of the 2nd International Titanium Conf., Cambridge, MA, May 2-5, 72, pp. 1969-1980.

F. H. Froes & W. T. Highberger, "Synthesis of Corona 5 (Ti-4.5Al-5Mo-1.5Cr)", Journal of Metals, vol. 32, No. 5, May 1980, pp. 57-64.

F. H. Froes, C. F. Yolton, J. C. Chesnutt & C. H. Hamilton, "Microstructural Control in Titanium Alloys for Superplastic Behavior", Conf., on Forging & Properties of Aerospace Materials, Leeds, England Jan. 5-7, 1977, Proceedings, pp. 371-398.

J. F. Dolowy, B. A. Webb & W. C. Harrigan, "Fiber Reinforced Titanium Composite Materials", Enigma of the 80's: Environment, Economics and Energy, vol. 24, Book 2, 1979, published by SAMPE, pp. 1443-1450.

A. G. Metcalfe, "Interaction and Fracture of Titanium-Boron Composites", Journal of Composite Materials, vol. 1, Oct. 1967, pp. 356-365.

London, "Titanium Matrix Composites", Titanium and Titanium Alloys, vol. 3, Proceedings 3rd Int. Conf. on Titanium, May 18-21, 1976, pp. 2389-2410.

Shorshorov et al., "Investigation of Structure of Titanium Matrix Fiber Composites", Titanium and Titanium Alloys, vol. 3, Pro. 3rd Int. Conf. on Titanium, May 18-21, 1976, pp. 2411-2417.

*Primary Examiner*—Peter K. Skiff

*Attorney, Agent, or Firm*—Donald J. Singer; Charles E. Bricker

[57] ABSTRACT

Titanium alloy composites having substantially reduced reaction zones are provided which comprise a high strength/high stiffness filament such as silicon carbide, silicon carbide-coated boron, boron carbide-coated boron and silicon-coated silicon carbide, embedded in a fine-grained titanium alloy containing at least 40 percent beta phase, less than 7 percent Al and having a beta-transus temperature below 1750° F. (955° C.).

Also provided is a method for fabricating titanium composites which comprises mechanically working a desired titanium alloy to obtain sheetstock in a desired thickness and having a relatively fine grain size, laying up a preform and consolidating the preform under increased temperature and pressure, wherein consolidation is carried out at a temperature below the beta-transus temperature of the alloy, thereby reducing the amount of reaction zone between the filament and the alloy matrix.

3 Claims, No Drawings

TITANIUM METAL-MATRIX COMPOSITES

RIGHTS OF THE GOVERNMENT

The invention described herein may be manufactured and used by or for the Government of the United States for all governmental purposes without the payment of any royalty.

BACKGROUND OF THE INVENTION

The present invention relates to metal/fiber composite materials, and in particular, to titanium matrix composites.

In recent years, material requirements for advanced aerospace applications have increased dramatically as performance demands have escalated. As a result, mechanical properties of monolithic metallic materials such as titanium often have been insufficient to meet these demands. Attempts have been made to enhance the performance of titanium by reinforcement with high strength/high stiffness filaments.

Titanium matrix composites have for quite some time exhibited enhanced stiffness properties which approach rule-of-mixtures (ROM) values. However, with few exceptions, both tensile and fatigue strengths are well below ROM levels and are generally very inconsistant.

These titanium composites are fabricated by superplastic forming/diffusion bonding of a sandwich consisting of alternating layers of metal and fibers. At least four high strength/high stiffness filaments or fibers for reinforcing titanium alloys are commercially available: silicon carbide, silicon carbide-coated boron, boron carbide-coated boron and silicon-coated silicon carbide. Under superplastic forming conditions, the titanium matrix material can be made to flow without fracture occurring, thus providing intimate contact between layers of the matrix material and the fiber. The thus-contacting layers of matrix material bond together by a phenomenon known as diffusion bonding. At the same time a reaction occurs at the fiber-matrix interfaces, giving rise to what is called a reaction zone. The compounds formed in the reaction zone may include TiSi, $Ti_5Si$, TiC, TiB and $TiB_2$. The thickness of the reaction zone increases with increasing time and with increasing temperature of bonding. Titanium matrix composites have not reached their full potential, at least in part because of problems associated with instabilities of the fiber-matrix interface. The reaction zone surrounding a filament introduces new sites for crack initiation and propagation within the composite, which operates in addition to existing sites introduced by the original distribution of defects in the filaments. It is well established that mechanical properties are influenced by the reaction zone, that, in general, these properties are degraded in proportion to the thickness of the reaction zone.

It is, therefore, an object of the present invention to provide improved titanium composites.

It is another object of this invention to provide an improved method for fabricating titanium composites.

Other objects, aspects and advantages of the present invention will be apparent to those skilled in the art from a reading of the following description of the invention and the appended claims.

SUMMARY OF THE INVENTION

In accordance with the present invention there is provided an improved titanium composite consisting of at least one filamentary material selected from the group consisting of silicon carbide, silicon carbide coated boron, boron carbide-coated boron and silicon-coated silicon carbide, embedded in a titanium alloy matrix which contains at least 40 percent beta phase, less than 7 percent aluminum and has a beta-transus temperature below 1750° F. (955° C.).

The method of this invention comprises the steps of mechanically working a titanium alloy having the aforementioned desired properties to obtain sheetstock or foil in a desired thickness and having a relatively fine grain size, fabricating a preform consisting of alternating layers of sheetstock and at least one of the aforementioned filamentary materials, and applying heat and pressure to the preform to consolidate the various layers, wherein consolidation is carried out at a temperature below the $\beta$-transus temperature of the alloy, thereby reducing the amount of the reaction zone between the fiber and the alloy matrix.

DESCRIPTION OF THE PREFERRED EMBODIMENTS

More particularly, the method of the present invention comprises the steps of starting with a fine grain alloy sheetstock, fabricating the preform, and consolidating the preform by superplastic-forming diffusion-bonding the preform in such manner that the grain size in the matrix is not substantially increased, i.e., the increase in grain size, if any, does not exceed 2×, and in such manner that the thickness of the reaction zone between the fiber and the alloy is substantially less than the reaction zone formed in conventional titanium composites made from alloys such as Ti-6Al-4V. In accordance with the present invention consolidation is carried out at a temperature substantially below that used for consolidation of such conventional titanium composites.

The titanium alloys employed according to the present invention are fine-grained, contain at least 40 percent of the beta phase, contain less than 7 percent Al and have a beta-transus temperature of less than 1750° F. (955° C.). Presently preferred titanium alloys are Beta III and CORONA 5. Beta III, nominally Ti-11.5Mo-6Zr-4.5Sn, is a metastable beta type alloy having a beta transus of about 1375° F. (745° C.). CORONA 5, nominally Ti-4.5Al-5Mo-1.5Cr, is a beta-rich, alpha-beta type alloy having a beta-transus of about 1700° F. (925° C.). Both alloys must be worked extensively at low temperature, i.e., about room temperature, followed by annealing to produce an ultrafine grain size. The Beta III alloy has good workability, both hot and cold. The CORONA 5 alloy must be annealed below its beta-transus temperature, in order to enrich the beta phase, before it can be extensively cold worked. The cold worked materials develop an ultrafine grain size, generally substantially less than 10 microns.

The high strength/high stiffness filaments or fibers employed according to the present invention are produced by vapor deposition of boron or silicon carbide to a desired thickness onto a suitable substrate, such as carbon monofilament or very fine tungsten wire. This reinforcing filament may be further coated with boron carbide, silicon carbide or silicon. To reiterate, at least four high strength/high stiffness filaments or fibers are commercially available: silicon carbide, silicon carbide-coated boron, boron carbide-coated boron, and silicon-coated silicon carbide.

Prior to fabricating the composite of this invention, it is preferred to clean the titanium alloy sheetstock. Such cleaning may be carried out by first pickling the sheetstock in, for example, an aqueous $NH_4$-HF-$HNO_3$ solution following, just prior to layup, by wiping the sheetstock with a highly volatile solvent, such as methyl ethyl ketone (MEK).

For each of handling it is preferred to introduce the filamentary material into the composite in the form of a sheet-like mat. Such a mat may be fabricated by laying out a plurality of filaments in parallel relation upon a planar surface and wetting the filaments with a fugitive thermoplastic binder, such as polystyrene. After the binder has solidified the filamentary material may be handled as one would handle any sheet-like material.

The composite preform may be fabricated in any manner known in the art. For example, alternating panels of alloy sheetstock and filamentary material may be stacked by hand in alternating fashion. Alternatively, the sheetstock may be wrapped on a large-diameter drum and the filamentary material wound therearound. Alternating layers of alloy sheetstock and filamentary material are thereafter wound onto the drum. Suitably sized sections of preform are cut from the drum layup. Generally, the filamentary material now available has an average diameter of about 0.0056 inch, while the sheetstock can be rolled to a thickness ranging from 0.003 to 0.015 inch or greater. It is preferred to use a sheetstock having a thickness of about 0.005 inch. The preform can be made in any desired thickness. The amount of filamentary material included in the preform should be sufficient to provide about 25 to 45, preferably about 35 volume percent of fibers.

Consolidation of the filament/sheetstock preform is accomplished by application of heat and pressure over a period of time during which the matrix material is superplastically formed around the filaments to completely embed the filaments. Prior to consolidation, the fugitive binder, if used, must be removed without pyrolysis occurring. By utilizing a press equipped with heatable platens and a vacuum chamber surrounding at least the platens and the press ram(s), removal of the binder and consolidation may be accomplished without having to relocate the preform from one piece of equipment to another.

The preform is placed in the press between the heatable platens and the vacuum chamber is evacuated. Heat is then applied gradually to cleanly off-gas the fugitive binder without pyrolysis occurring. After consolidation temperature is reached, pressure is applied to achieve consolidation.

Consolidation is carried out at a temperature in the approximate range of 10° to 100° C. (18° to 180° F.) below the beta-transus temperature of the titanium alloy. The consolidation of a composite comprising Beta III alloy is preferably carried out at about 730° C. (1350° F.), while a composite comprising CORONA 5 alloy is preferably consolidated at a temperature of about 850° to 905° C. (1565° to 1665° F.). The pressure required for consolidation of the composite ranges from about 10 to about 100 MPa and the time for consolidation ranges from about 15 minutes to 24 hours or more.

The following example illustrates the invention.

EXAMPLE

A series of unidirectionally reinforced composites were fabricated with about 35 nominal filament volume fraction using 0.0056 inch diameter silicon carbide-coated boron as the reinforcement material. The consolidation parameters are given in Table I below. Ti-6Al-4V, the control alloy, is a state-of-the-art material that has been extensively characterized for aerospace applications.

TABLE I

COMPOSITE FABRICATION PARAMETERS

| Sample No. | Matrix | Temperature, °C. (°F.) | Time hr | Pressure MPa (Ksi) |
|---|---|---|---|---|
| 1 (control) | Ti-6Al-4V | 925 (1700) | 0.50 | 70 (10) |
| 2 | CORONA 5 | 850 (1565) | 0.75 | 55 (8) |
| 3 | Beta III | 730 (1350) | 24 | 70 (10) |

Samples of each of the composites were metalographically prepared and high magnification (up to ×10,000) SEM photographis were taken of the reaction zone. The reaction zone formed between the Ti-6Al-4V control matrix and the fibers consisted of a uniform layer of intermetallic compounds approximately 0.5 μm thick. In contrast the thickness of the reaction zone in the CORONA 5 composite was about 0.25 μm, while that of the Beta III composite was very thin and irregular, being virtually nil.

It is readily apparent that the method of the present invention reduces the size of the reaction zone.

Various modifications may be made to the invention without departing from the spirit thereof as the scope or the following claims.

We claim:

1. A method for fabricating a titanium composite consisting of at least one filamentary material selected from the group consisting of silicon carbide, silicon carbide-coated boron, boron carbide-coated boron and silicon-coated silicon carbide, and a titanium alloy having the nominal composition Ti-4.5Al-5Mo-1.5Cr, which method comprises the steps of extensively mechanically working said alloy at about room temperature to obtain sheetstock in a desired thickness and having a grain size of less than 10 microns, fabricating a preform consisting of alternating layers of said sheetstock and at least one of said filamentary materials, and applying heat and pressure to consolidate said preform, wherein consolidation is carried out at a temperature about 10° to 100° C. below the beta-transus temperature of said alloy at a pressure in the approximate range of 10 to 100 MPa.

2. A titanium matrix composite structure consisting of at least one filamentary material selected from the group consisting of silicon carbide, silicon carbide-coated boron, boron carbide-coated boron, and silicon-coated silicon carbide embedded in a titanium alloy matrix having the nominal composition Ti-4.5Al-5Mo-1.5Cr, said composite having a reaction zone width at the filamentary material-matrix interface of less than about 0.5 μm.

3. The composite of claim 2 wherein said filamentary material is silicon carbide-coated boron, and said reaction zone width is about 0.25 μm.

* * * * *